US005697502A

United States Patent [19]

Linz

[11] Patent Number: 5,697,502

[45] Date of Patent: Dec. 16, 1997

[54] PACKAGING UNIT FOR NOTIONS

[75] Inventor: Andreas Linz, Barcelona, Spain

[73] Assignee: Guetermann & Co. AG, Zuerich, Switzerland

[21] Appl. No.: 595,856

[22] Filed: Feb. 6, 1996

[30] Foreign Application Priority Data

Feb. 17, 1995 [DE] Germany ..... 295 02 589 U

[51] Int. Cl.[6] ..... B65D 85/02

[52] U.S. Cl. ..... 206/779; 206/395; 206/806

[58] Field of Search ..... 206/775, 779, 206/806, 769, 408, 389, 461, 464, 784, 395, 400, 401

[56] References Cited

U.S. PATENT DOCUMENTS

| | | | |
|---|---|---|---|
| 2,519,706 | 8/1950 | Ryan | 206/408 |
| 2,979,192 | 4/1961 | Blonder | 206/779 |
| 3,185,292 | 5/1965 | Maro | 206/779 |
| 3,443,738 | 5/1969 | Devejian | 206/395 |
| 3,491,876 | 1/1970 | Zecchin | 206/408 |
| 3,608,156 | 9/1971 | Ward | 206/389 |
| 3,964,606 | 6/1976 | Hogg et al. | 206/395 |
| 4,120,395 | 10/1978 | Mandel et al. | 206/227 |
| 4,140,218 | 2/1979 | Forte | 206/395 |
| 4,362,239 | 12/1982 | Roccaforte | 206/806 |
| 5,002,187 | 3/1991 | Rysner et al. . | |
| 5,271,494 | 12/1993 | Odermatt et al. | 206/227 |

FOREIGN PATENT DOCUMENTS

| | | |
|---|---|---|
| 91 01 502.2 | 6/1991 | Germany . |
| 92 04 032.2 | 8/1992 | Germany . |
| 92 09 277.2 | 10/1992 | Germany . |
| 91 07 675.7 | 11/1992 | Germany . |
| 92 06 035.8 | 10/1993 | Germany . |
| 93 20 641 | 12/1994 | Germany . |
| 94 20 903 | 3/1995 | Germany . |

*Primary Examiner*—Paul T. Sewell
*Assistant Examiner*—Nhan T. Lam
*Attorney, Agent, or Firm*—Spencer & Frank

[57] ABSTRACT

A packaging unit includes: a first section defining a first recess therein and a slot disposed at a side thereof situated opposite the first recess; a second section elongated with respect to the first section, being connected to the first section and defining a first fold therebetween, the first section and the second section together forming an L shape in an unfolded state of the packaging unit, the second section further defining a second recess therein having a shape identical to that of the first recess and being disposed such that, when the first section is folded onto the second section along the first fold, the first recess and the second recess register with one another for forming an aperture for engagement with a hanging element; a third section connected to the second section and defining a second fold therebetween; a fourth section connected to the third section and defining a third fold therebetween, the fourth section further defining a single recess therein corresponding to a shape of at least a portion of a product to be packaged; a fifth section connected to the fourth section and defining a fourth fold therebetween; and a closing flap connected to the fifth section and defining a fifth fold therebetween, the closing flap having a slot portion being configured to be inserted into the slot when respective ones of the sections are folded upon one another along respective ones of the folds for placing the packaging unit in a folded state.

7 Claims, 3 Drawing Sheets

PACKAGING UNIT FOR NOTIONS

CROSS-REFERENCE TO RELATED APPLICATION

This application claims the priority of patent application Ser. No. 295 02 589.1 filed in Germany on Feb. 17, 1995, the subject matter of which is incorporated herein by reference.

BACKGROUND OF THE INVENTION

The present invention relates to a packaging unit for notions, particularly for spools of sewing thread, which is suited especially for self-service sales.

In the design of sales packagings for self-service sales, the problem arises that, on the one hand, the goods to be sold must be held in the packaging securely and durably while the view of the product itself must not be restricted. The packaging must be compact but, nevertheless, it must provide sufficient space for decoration surfaces and inscription surfaces.

For packagings for self-service products, the packaging unit must be able to securely hold the product while it must further be possible to securely hold the packaging unit itself in a self-service rack.

Another important point is that, naturally, the packaging makeup should be produced in an ecologically beneficial manner and that its disposal after use should also not present any problems.

SUMMARY OF THE INVENTION

It is the object of the present invention to provide a packaging unit for notions which is made up of an ecologically friendly material, which allows a simple but secure packaging of the product, and which makes it possible to display the product in a favorable manner.

With the above objects in view, the present invention provides a packaging unit comprising that is a cardboard strip which is provided with a closing mechanism comprising a closing flap and a slot.

An essential characteristic of the present innovation is that the packaging unit is made exclusively from ecologically friendly cardboard material, with the basic form being comprised of a piece of cardboard which is correspondingly cut to size and made to assume the desired final shape of the packaging by corresponding folding.

The packaging is closed by means of a closing flap. The closure system is very simple, it is secure and a virtually invisible closure is possible.

The entire packaging unit can be hung in a sales rack by means of a recess provided for this purpose.

Thus, a packaging unit is created which is easy to produce, easy to use and, ultimately, easy to dispose of. Since the packaging is made of only one type of ecologically friendly material, with economical material consumption as a consideration, the customers' demand for less packaging material is further met.

One advantage of the packaging makeup according to the innovation is that the simple closing mechanism by means of an insertion flap allows a clean, simple and invisible closure. Another advantage is that the packaging has sufficiently large surfaces for inscription and decoration, with it only being necessary to print on these visible advertising surfaces. This results in an extremely favorable production. In the basic state of the packaging, the advertising surfaces are disposed on the same side of the cardboard strip so that printing (gluing) must take place on one side only.

Combination of the above features with one another is further possible according to the invention.

DETAILED DESCRIPTION OF THE PREFERRED EMBODIMENT

Figure 1:
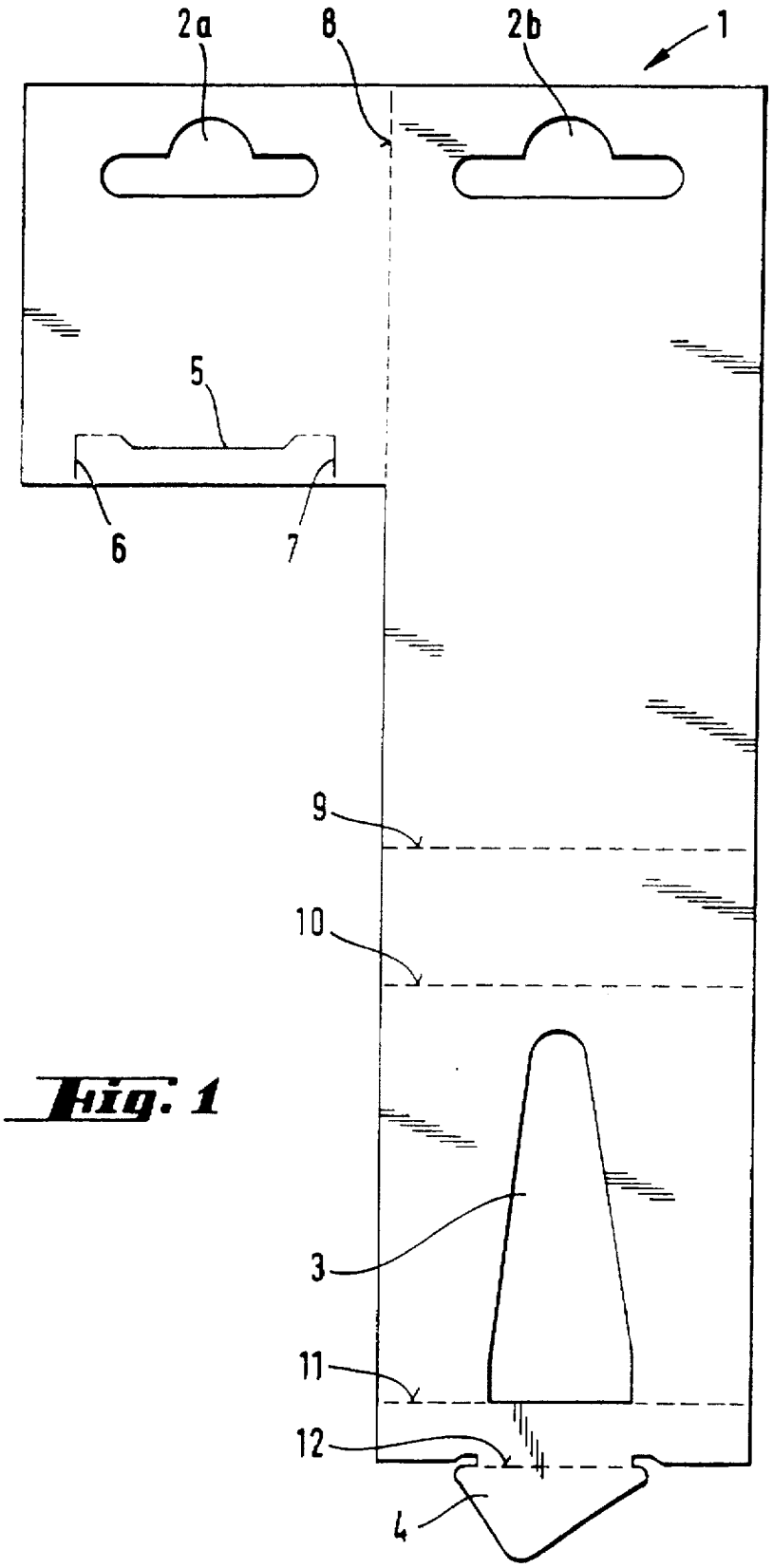
FIG. 1 shows a top plan view of a packaging unit completely cut to size in the initial state.

FIG. 1 illustrates the initial form of the novel packaging unit. This form comprises a cut-to-size, approximately L-shaped cardboard strip 1, which is provided with three recesses therein. Recesses **2*a* and 2*b* are designed for the engagement of a hanging hook, while recess 3** is designed to secure the product in the manner described below.

At one end, the cardboard strip 1 is provided with a closing flap 4 which is configured to be approximately arrow-shaped. Preferably, the arrow shape is somewhat asymmetrical, thus facilitating the insertion of the closing flap 4. Furthermore, the cardboard strip 1 has a slot 5 and incisions 6 and 7 arranged to the right and left of the slot.

Until the final shape of the packaging unit is reached, the cardboard strip 1 must be folded accordingly; therefore, folds 8–12 are already prepared.

Figure 2:
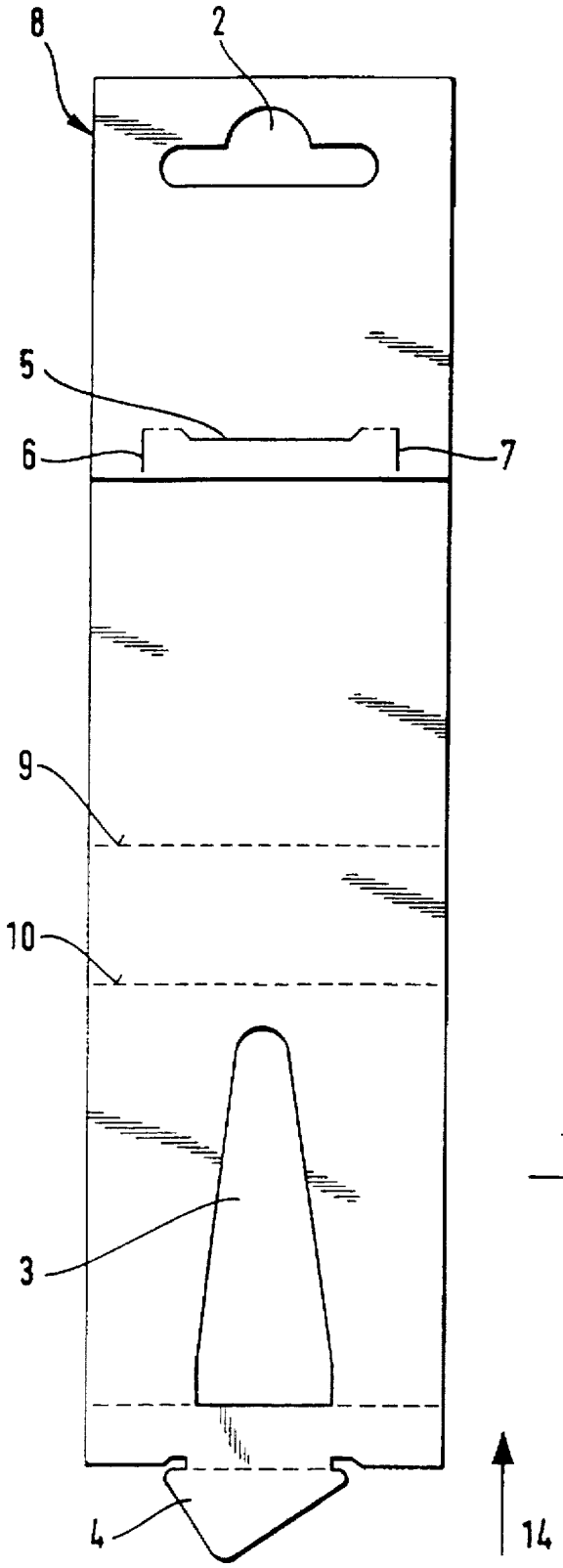
FIG. 2 shows a top plan view of a packaging unit according to FIG. 1 after a first folding step.

In a first step according to FIG. 2, the cardboard strip 1 is folded along fold 8 so that recesses **2*a* and 2*b* are exactly congruent with one another. Preferably, the folded over cardboard section is glued to the lower cardboard section. By way of this first step, slot 5 is placed precisely opposite of the closing flap 4**.

Figure 3:
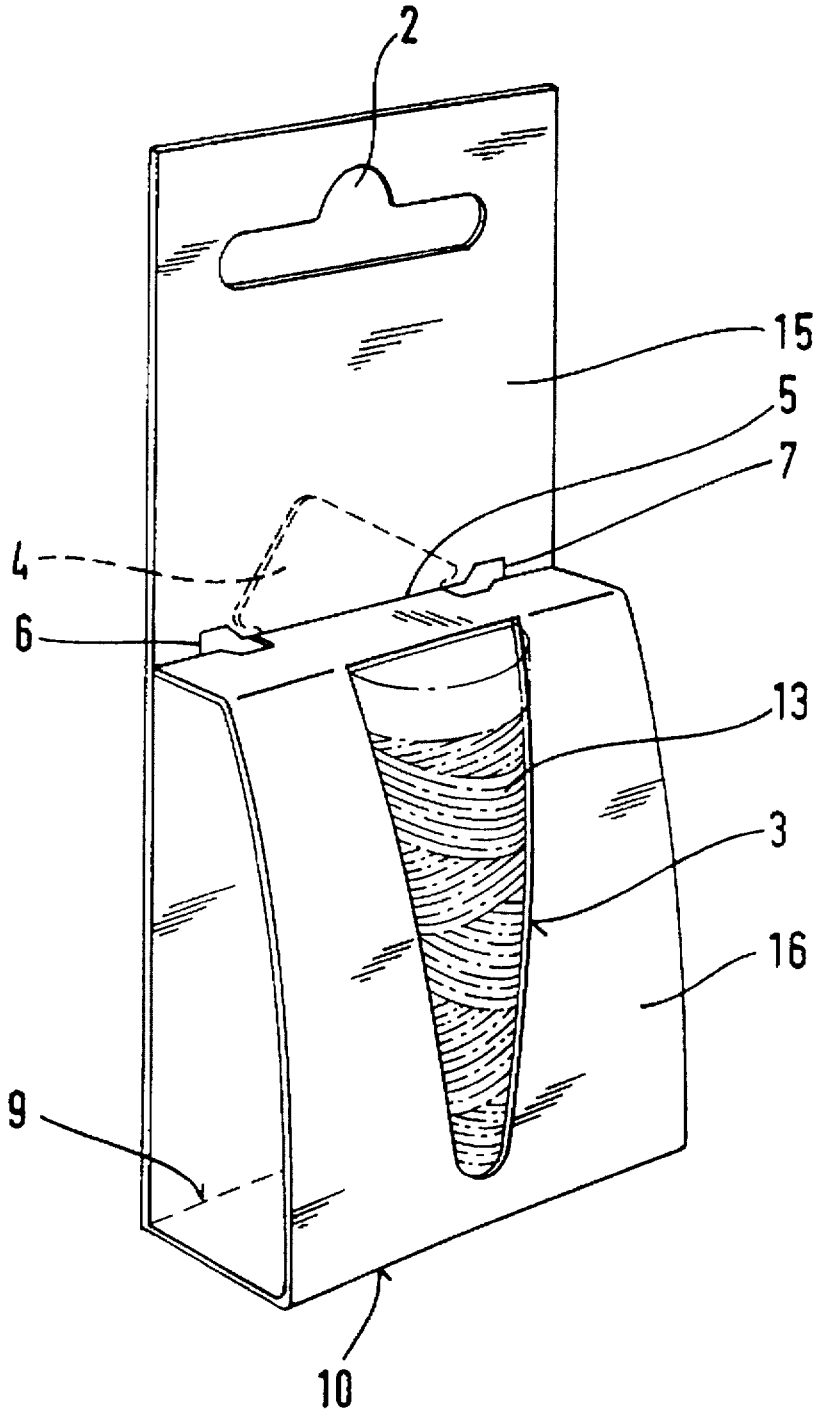
FIG. 3 shows a perspective view of a final state of the packaging unit with the held product.

In a next step according to FIG. 3, the sales product, here, e.g., a thread spool 13, is placed into recess 3. Simultaneously, the cardboard strip 1 is folded in the direction 14 while taking account of folds 9–11 so as to subsequently close the packaging unit by inserting the closing flap into slot 5.

Fold 12 on the closing flap 4 as well as incisions 6 and 7 in the proximity of slot 5 facilitate the insertion of closing flap 4. The asymmetrical arrow shape of the closing flap 4 is also of advantage during closing and opening.

The thread spool 13 is now held securely in recess 3 of the packaging unit. The entire packaging unit can now be hung into the sales rack. Surfaces 15 and 16 preferably serve as inscription and advertising surfaces. It is advantageous that only these visible surfaces 15 and 16 of the cardboard strip 1 must be printed, thus saving material and costs. Here, printing is only necessary on one side, with the printing preferably taking place in the initial state of the packaging.

It will be understood that the above description of the present invention is susceptible to various modifications, changes and adaptations, and the same are intended to be comprehended within the meaning and range of equivalents of the appended claims.

What is claimed is:

1. A packaging unit comprising:

a first section defining:

a first recess therein; and a slot disposed at a side thereof situated opposite the first recess;

a second section elongated with respect to the first section, being connected to the first section and defining a first fold therebetween, the first section and the second section together forming an L shape in an unfolded state of the packaging unit, the second section further defining a second recess therein having a shape identical to that of the first recess and being disposed such that, when the first section is folded onto the second section along the first fold, the first recess and the second recess register with one another for forming an aperture for engagement with a hanging element;

a third section connected to the second section and defining a second fold therebetween;

a fourth section connected to the third section and defining a third fold therebetween, the fourth section further defining a single recess therein corresponding to a shape of at least a portion of a product to be packaged, the single recess being a third recess;

a fifth section connected to the fourth section and defining a fourth fold therebetween; and a closing flap connected to the fifth section and defining a fifth fold therebetween, the closing flap having a slot portion being configured to be inserted into the slot when respective ones of the sections are folded upon one another along respective ones of the folds for placing the packaging unit in a folded state.

2. The packaging unit according to claim 1, wherein:

the first section further defines a plurality of incisions disposed to each side of the slot; and the closing flap further includes incision portions being configured to be inserted into respective ones of the incisions when respective ones of the sections are folded upon one another along respective ones of the folds for placing the packaging unit in a folded state.

3. The packaging unit according to claim 1, wherein the sections and the closing flap comprise a cardboard strip.

4. The packaging unit according to claim 1, wherein the aperture is disposed at an upper region of the packaging unit in its folded state.

5. The packaging unit according to claim 1, further comprising printed material on a single side thereof.

6. A method of placing the packaging unit according to claim 7 in its folded state, the method comprises the steps of:

folding the first section onto the second section along the first fold thereby registering the first recess and the second recess with one another;

placing at least a portion of the product to be packaged in the third recess after the step of folding the first section;

folding respective ones of the closing flap, the fifth section, the fourth section, the third section and the second section upon one another along respective ones of the fifth fold, the fourth fold, the third fold and the second fold; and inserting the slot portion of the closing flap into the slot after the step of folding respective ones of the closing flap, the fifth section, the fourth section, the third section and the second section for placing the packaging unit in its folded state.

7. The method according to claim 6, wherein the step of folding the first section comprises the step of gluing the first section onto the second section.

* * * * *